United States Patent [19]

Altare

[11] Patent Number: 5,046,721

[45] Date of Patent: Sep. 10, 1991

[54] MAN POWERED GYROSCOPE

[76] Inventor: William C. Altare, 8222 Mason Ave., Winnetka, Calif. 91306

[21] Appl. No.: 589,727

[22] Filed: Sep. 28, 1990

Related U.S. Application Data

[63] Continuation-in-part of Ser. No. 412,138, Sep. 25, 1989, abandoned.

[51] Int. Cl.[5] ..... A63G 1/00

[52] U.S. Cl. ..... 272/36; 272/33 R; 272/50

[58] Field of Search ..... 272/33 R, 36, 44, 50

[56] References Cited

U.S. PATENT DOCUMENTS

| | | | |
|---|---|---|---|
| 846,925 | 3/1907 | Kramel | 272/36 |
| 1,342,871 | 6/1920 | Ruggles | 272/36 X |
| 3,141,669 | 7/1964 | Chul | 272/36 X |
| 3,164,382 | 1/1965 | Johnson | 272/33 R |
| 3,276,777 | 10/1966 | Priuitt, Sr. | 272/36 |
| 4,402,500 | 9/1983 | Coles | 272/33 R |
| 4,799,667 | 1/1989 | Suchy | 272/36 |
| 4,824,099 | 4/1989 | Rusu et al. | 272/33 R |

*Primary Examiner*—Richard E. Chilcot, Jr.

*Attorney, Agent, or Firm*—Beehler & Pavitt

[57] ABSTRACT

Three rings of different diameters are pivotally interconnected at their perimeters so that they can rotate with respect to each other. The innermost ring, larger in diameter than the height of a man, is pivotally attached only to the intermediate ring on one axis. The intermediate ring is pivotally attached to the outermost ring on another axis. The outermost ring is supported by a pivotal mounting at opposite ends of a semicircular supporting bracket.

A foot plate for supporting a man as the operator at the center of the innermost ring is mounted in turn on the lower edge of the innermost ring. There is a waistband for stability midway between bottom and top edges of the innermost ring and a handlebar at the same top edge.

While the operator is taking his position on the foot plate, a locking bar holds all three rings in place in vertical position concentric with each other. Once the operator is in position, the locking bar is removed and the operator, by shifting his position while attached to the foot plate, can move all the rings to different positions so the operator's body can be shifted about into different chosen positions.

13 Claims, 5 Drawing Sheets

10
45
46
70
15
14
13
72
71
36
37
2
50
17
73
3
16
40
41
48
75
49
74
5
4
60
34
66
32
85
62
63
90
61
25
30
47
24
23
21
18
19
20
12
35
22
11

36
39
13
53
51
50
15
41
14
48
34
40
38
37
54
55

Fig. 3.
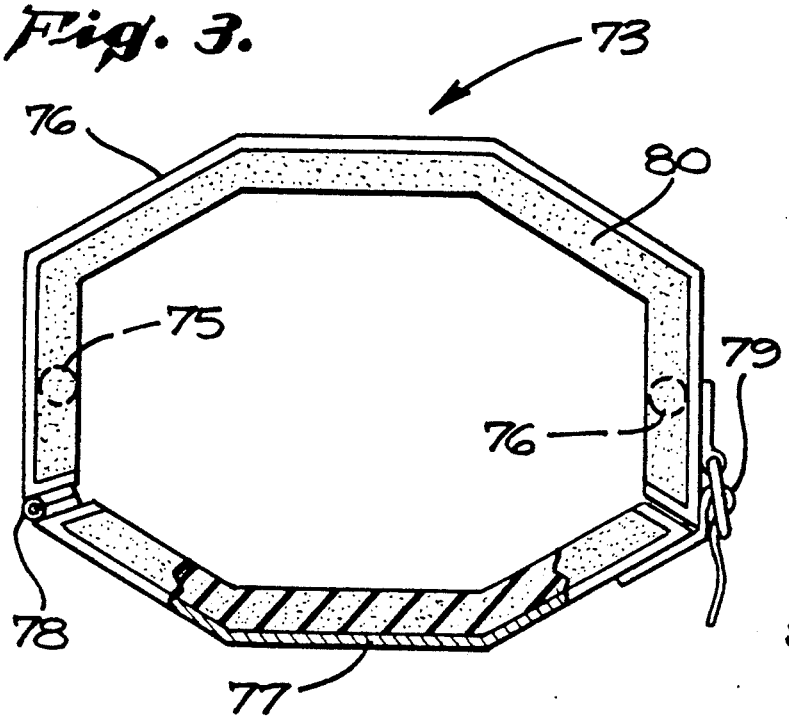
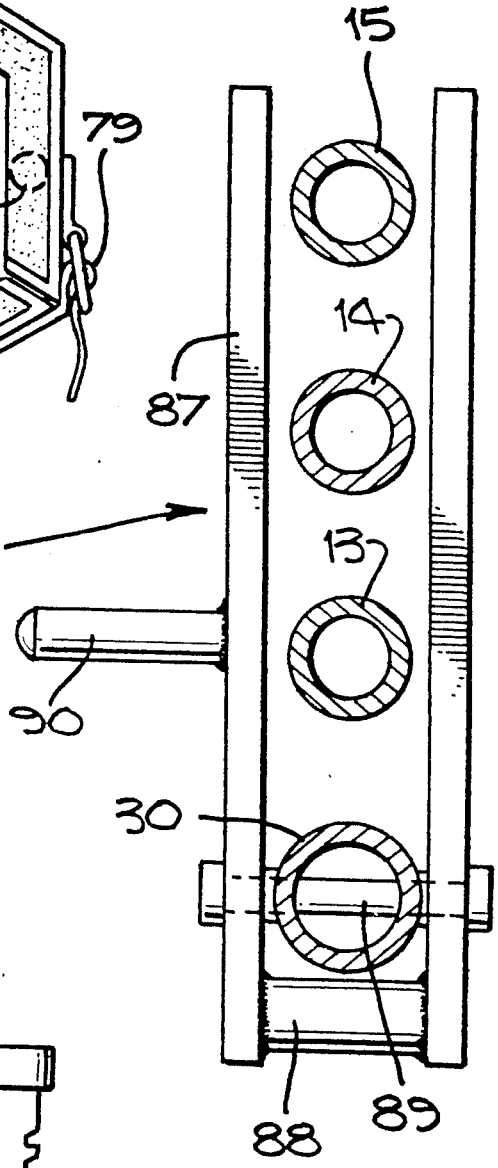
Fig. 5.
Fig. 4.
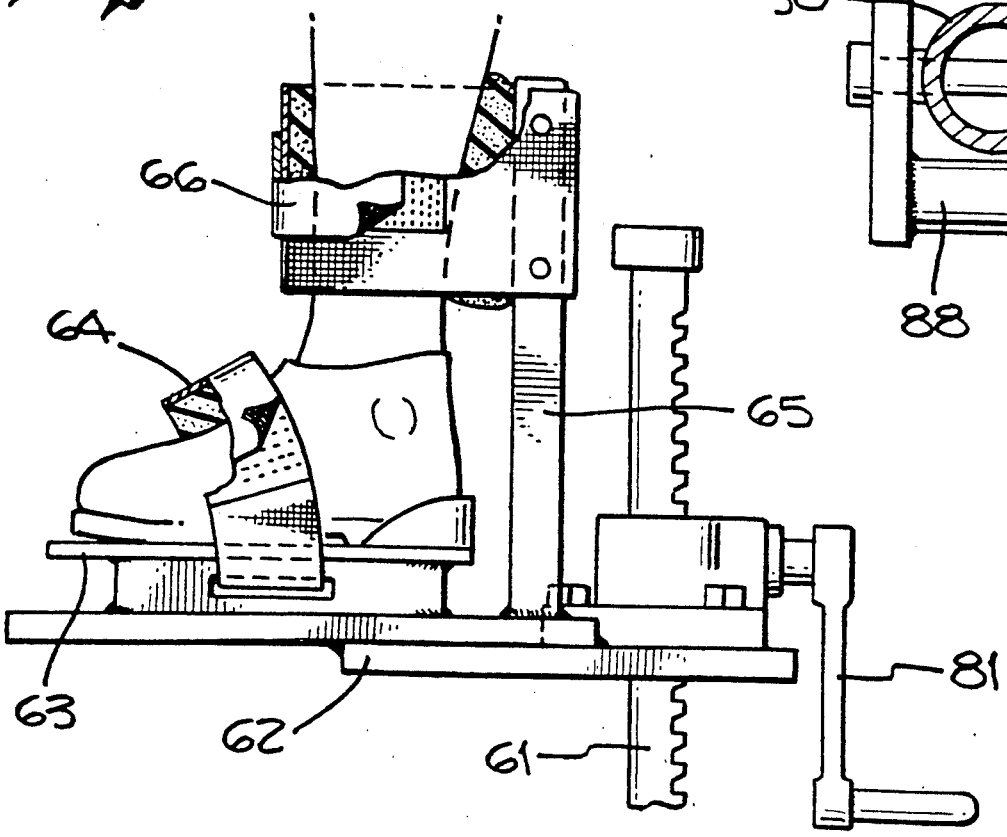

MAN POWERED GYROSCOPE

This is a continuation-in-part of patent application Ser. No. 07/412,138, filed Sept. 25, 1989 now abandoned.

In the field of activity devoted to amusement, appreciable attention has been given to apparatus commonly described as exciting rides. These can be exemplified, for example, as roller coasters, Ferris wheels, .water chutes, and merry-go-rounds, to mention a few suitable for groups of people. Other devices are those which test the skill and ability of single individuals, as may be exemplified by ring tossing, dart throwing, golf practice, shooting ranges, and gymnastic apparatus of various kinds.

The invention here disclosed is one predicated upon a scientific instrument enlarged to a size sufficient to accept a human being as both the personal operator and the entire source of power for its operation. Further still, the device features a scientific type of apparatus of a nature not commonly understood and built in a fashion so that the operating parts of the structure and the operator himself are boldly exposed to view.

More particularly, the disclosure is that of a typical gyroscope large enough to be occupied by a human being as the source of energy and motion and so built that all operating parts are open to view on all sides.

Among the objects of the invention is to provide a new and improved workout and amusement apparatus in the form of a man-sized gyroscopic structure in which a human can be secured at the center and serve as the source of power for manipulating the structure into its various attitudes.

Another object of the invention is to provide a new and improved workout and amusement apparatus in the form of a man-sized gyroscope structure in which a man can position himself and provide the entire source of energy and movement to generate motion of the apparatus into all of its available attitudes.

Another object of the invention is to provide a new and improved workout and amusement apparatus in the form of a man-sized gyroscope structure in which a man can position himself and, after providing the entire source of energy and movement to generate motion of the apparatus into all of its available attitudes, the man can act to cease movement of the structure and lock the structure in a stationary position whereby he can safely dismount from the structure.

Still another object of the invention is to provide a new and improved workout and amusement apparatus in the form of a man-sized gyroscopic structure which can accommodate an active human body centerably adjusted in a position exposed in virtually all directions while the structure is at rest and then subsequently released so that the man as the occupant, and without assistance of any kind, can shift the structure with himself into virtually all of its attitudes.

Further included among the objects of the invention is to provide a new and improved workout and amusement apparatus which accepts a man as an occupant and operator, irrespective of his height, weight or shape, at a station clear of hazards, the structure being relatively simple, readily serviced and repaired, and wherein virtually all major operating parts, together with the entire person of the occupant, can be exposed to view.

Also included among the objects of the invention to which reference herein is made is to provide the structure as a composite device with ready mobility and adjustability so that the structure can be placed promptly in available and advantageous locations and once in place be immediately placed in service.

With these and other objects in view, the invention consists of the construction, arrangement and combination of various parts of the device, serving as sundry examples of several embodiments of the invention whereby the objects contemplated are attained as hereinafter disclosed in the specification and drawings and pointed out in the appended claims.

IN THE DRAWINGS

FIG. 3 is a fragmentary cross-sectional view on the line 3—3 of FIG. 1.

FIG. 4 is a fragmentary side elevational view on the line 4—4 of FIG. 1 partially broken away.

FIG. 5 is a fragmentary cross-sectional view on the line 5—5 of FIG. 1 showing the ring lock in locked adjustment.

Figure 1:
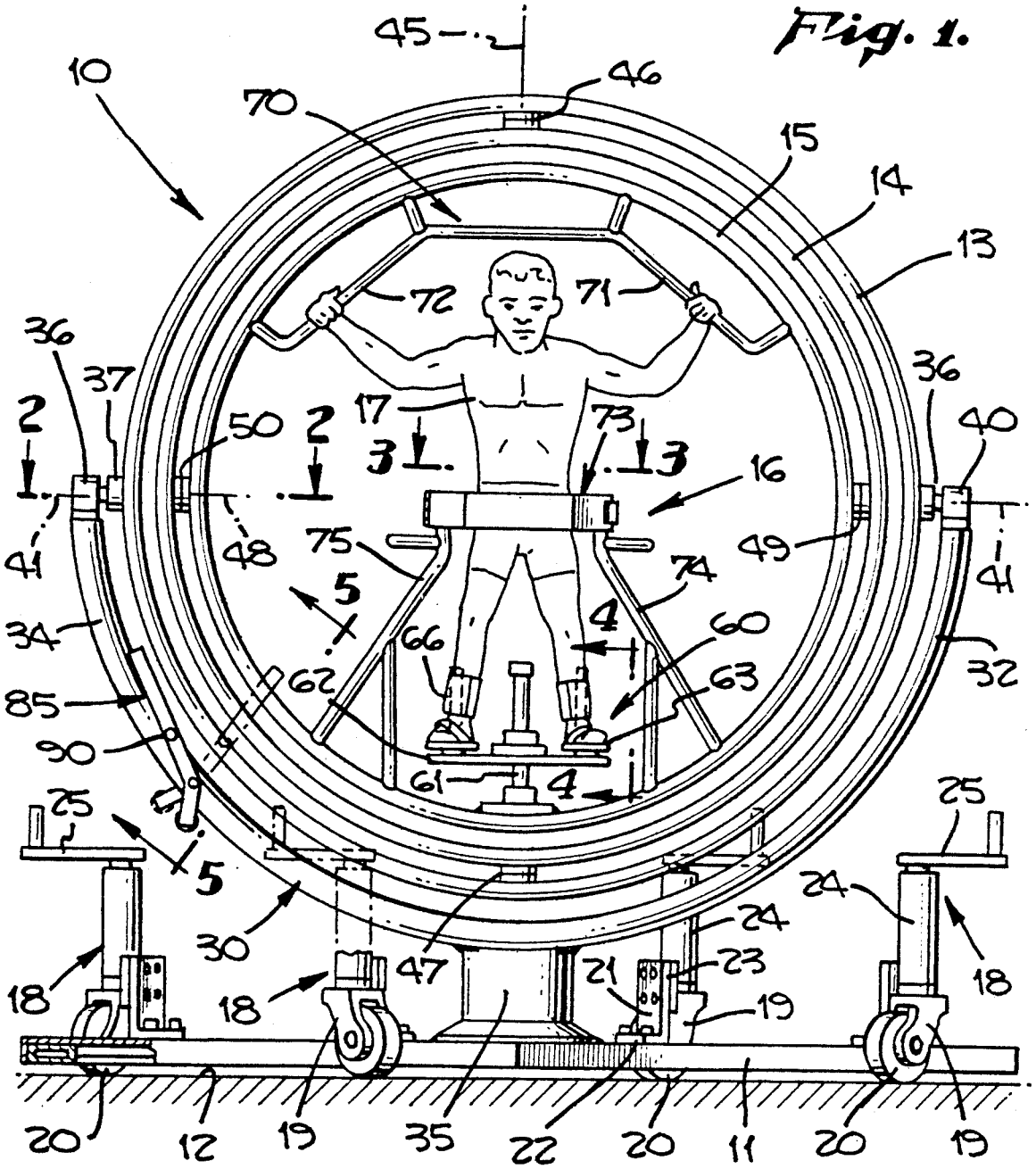
FIG. 1 is a front elevational view of one embodiment of the structure locked in loading position and with the operator in place.

In one embodiment of the invention chosen for the purpose of illustration, there is shown in FIG. 1 a gyroscopic structure 10, mounted upon a supporting plate 11 so that it can be moved about from place to place over a surface 12. Although a simplified ring structure of one or two rings may be utilized, the gyroscopic structure of the preferred embodiment consists of a three-ring assembly, of which there is an outermost ring 13, an intermediate ring 14, and an innermost ring 15. Within the innermost ring 15 is an operator station 16 for accommodation of a human operator, here shown as a man 17.

For assistance in moving the gyroscopic structure 10, the supporting plate 11, which may be referred to as a base shell, is provided at each of four locations with a jack assembly 18 carried by a caster 19 and its roller 20. For each caster 19 and its roller 20 there is a bracket 21 with one arm 22 attached to a cylindrical portion 24 of the jack assembly.

In order to adjust each of the jack assemblies up or down as may be needed to hold the supporting plate 11 clear of the surface 12 when moved about and to level the supporting plate as needed, each of the jack assemblies is provided with a crank 25.

When the gyroscopic structure is at rest and ready for reception or discharge of an operator 17, the rings are concentrically disposed, all in the same vertical plane, as shown in FIGS. 1 and 5. The ring assembly is carried by and supported in position on the supporting plate by use of an arcuate yoke 30. Right end 32 of the yoke 30 is mounted to and supports the gyroscopic structure. Similarly, left end 34 of the yoke 30 is mounted to and supports the gyroscopic structure. At the center of the yoke there is a support consisting of a riser column or pedestal 35, welded to the arcuate yoke 30 at the top and welded to the supporting plate at the bottom. This pedestal is preferably the sole support for the yoke. There is a stationary mounting provided for the ring assembly by virtue of the outermost ring 13 being carried by the respective opposite ends of the arcuate yoke 30. The pedestal mount 35, in combination with yoke 30, provides sufficient flexibility to absorb the shock caused by the operator's vigorous use of this device. The absorbing of shock in this support system prevents the machine from "walking" or bouncing over the ground as it is used. Also, the ride is smoother and more comfortable than with a rigid support system. This enhances the enjoyment of use and improves safety.

More specifically, for attachment of the yoke to the outermost ring 13 there is what may be referred to as a pillow block bearing assembly 36 at each end of the yoke. A flange plate 37 of the assembly is shown welded to the outermost ring 13 at each diametrically opposite location, the assembly at the left end being shown as an example. A shaft 38 is rotatably supported in a bearing ring within the flange plate 37. From this the shaft extends radially outwardly into engagement with a block 40 at the end of the yoke. By the mounting described, the outermost ring 13 is enabled to rotate throughout an arc of 360 degrees about a horizontal axis 41 of the outermost ring 13.

The intermediate ring 15 is mounted to enable it to rotate, as viewed in FIG. 1, about a vertical axis 45 throughout an arc of 360 degrees. This is accomplished by providing bearings 46 and 47 interconnecting the rings at upper and lower diametrically opposite locations, as viewed in FIG. 1.

Further as shown in FIG. 1, the innermost ring 15 is mounted so that it can rotate for a distance of 360 degrees about a horizontal axis 48 which is temporarily coincident with the horizontal axis 41, as viewed in FIG. 1. To provide for the rotation made reference to, there is a bearing 49 at the right side of the axis, as viewed in FIG. 1, between the innermost ring 15 and the intermediate ring 14, and a similar bearing 50 at the left side.

Figure 2:
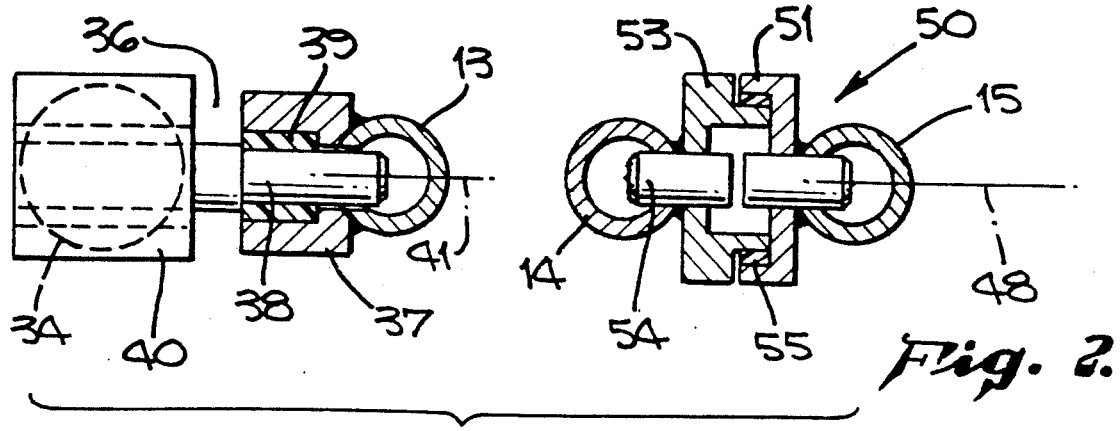
FIG. 2 is a fragmentary sectional view of the structure on the line 2—2 of FIG. 1.

As shown more particularly in FIG. 2, the bearing 50 which is typical of all the bearings 46, 47 and 49, consists of a flange 51 and its shaft 52 attached to the innermost ring 15 by a conventional weldment. A bearing ring 55 provides for rotation between the flanges. A complementary flange 53 and its shaft 54 are welded to the intermediate ring 14.

The bearing 49 on the diametrically opposite side is similarly constructed and attached to the respective innermost and intermediate rings at the diametrically opposite side and in this way provides for the innermost ring to rotate throughout a 360 degree arc with respect to the intermediate ring 14.

Since the human operator 17 is to be the source of power for manipulation of the gyroscopic structure, the operator station 16 is attached to and carried by the innermost ring 15. In the chosen embodiment the operator station consists of various expedients for securing the human operator 17 in the position he is to occupy within the innermost ring, and further to occupy in a fashion permitting movement of his body to a limited degree while at the operator station.

For assistance of the operator, there is a foot assembly 60 which in the chosen embodiment consists of a jack 61 anchored to the innermost ring 15. Mounted on the jack is a platform 62 with a foot plate 63 for each foot. Each foot plate is provided with an adjustable strap 64 for anchoring the respective foot in secure position on the platform. An upper post 65 projecting upwardly from the rear of the platform 62 is provided with an adjustable cushioned leg band 66 for attachment of the corresponding leg. A handlebar 70 is also provided in the chosen embodiment. The handlebar consists of interconnected rails 71 and 72 anchored to the innermost ring 15 at a comfortable location near the head and shoulders of the human operator 17.

To further stabilize the human operator in position, there is provided a waistband, indicated generally by the reference character 73 attached by means of legs 74 and 75 to the innermost ring 15 at corresponding opposite sides of the foot assembly 60 In the chosen embodiment, the waistband consists of a stationary section 76 and a gate section 77, the stationary section 76 being the portion of the waistband mounted on the legs 74 and 75. A hinge 78 at one end of the gate section (see FIG. 3) attaches the gate section to the stationary section and a latch 79 at the opposite end allows the gate section to be swung open when the human operator takes his position, thereafter to be secured by the latch 79. A cushion 80 is provided throughout the interior of the waistband.

To further assist in properly positioning the human operator with respect to the ring assembly, the platform 62 of the foot assembly 60 is mounted on the jack 61 in a manner enabling it to be raised and lowered. To accomplish this there is a crank 81 mounted preferably at the rear of the jack 61, having a degree of adjustment sufficient to elevate the platform 62, should the human operator be shorter than average, or to lower the platform, should the human operator be taller than average. The waistband is preferably made of a size to fit loosely about the human operator so as to enable the operator to shift his weight and position while mounted at the operator station.

While the gyroscopic structure is at rest, being moved about, and also during loading and unloading, it is desirable to have the rings of the ring assembly temporarily secured to each other and to the yoke. This is accomplished by provision of a lock bar assembly 85, see FIGS. 1 and 5. In the chosen embodiment the lock bar assembly consists of inner and outer bars 86 and 87 attached together at one end by a block 88. By use of the block, the bars are spaced wide enough apart so as to form a space between them sufficient to accommodate the thickness of the rings 13, 14 and 15 and also the thickness of the yoke 30. A bolt 89 projects through the yoke so that the lock bar assembly can pivot from the solid line unlocked position of FIG. 1 to the broken line locked position. A handle 90 is mounted on the outer bar 87 for shifting the lock bar assembly between locked and unlocked positions.

In operation, the gyroscopic structure, mounted as shown and described on the supporting plate, is moved to a desired location while traveling on the casters 19. Once at the desired location, it is preferable to level the supporting plate by manipulation of the cranks 25. During this and the loading operation, the rings of the ring assembly are interlocked in vertical concentric position with each other and with respect to the yoke 30. The gate section 77 of the waistband 73 is then swung open and the human operator 17 takes his position on the foot assembly 60 where his feet are fastened by use of the adjustable straps 64 and legs fashioned by the cushioned adjustable bands 66. At this stage the foot assembly may be moved up and down, depending upon how tall or short the human operator may be in order to adjust his center of gravity with respect to the geometric center of the innermost ring 15. The gate is then closed and latched and the operator is free to grasp the handlebars 71 and 72, as pictured in FIG. 1.

After this has been accomplished, the lock bar assembly 85 is moved to the open solid line position of FIG. 1, and the human operator is thereafter free to manipulate the gyroscopic structure in whatever manner he may wish. Manipulation may be accomplished by the operator changing position, either vertically or laterally, with his arms, torso and legs in any manner within the freedom of his attachment. The changes in bodily position cause the several rings to shift about their respective axes so that the human operator can assume an upside-down position with all stages in between as well as tilting in a sidewise direction. Should the human operator choose, he can, by manipulation of his person, cause continuous motion in any chosen direction or stop the motion in whatever position might be chosen. The activity depends upon the ingenuity and stamina of the human operator. Continuous motion may be achieved or motion temporarily arrested in whatever attitude the human operator finds acceptable.

After a period of operation satisfactory to the occupant, the occupant can return to initial position, either by his own manipulation or with the assistance of an attendant. When ready to leave the structure, the locking bar assembly is returned to locked position, the adjusting bands and adjusting straps released, and the operator is then able to step down and leave the gyroscopic structure.

Figure 6:
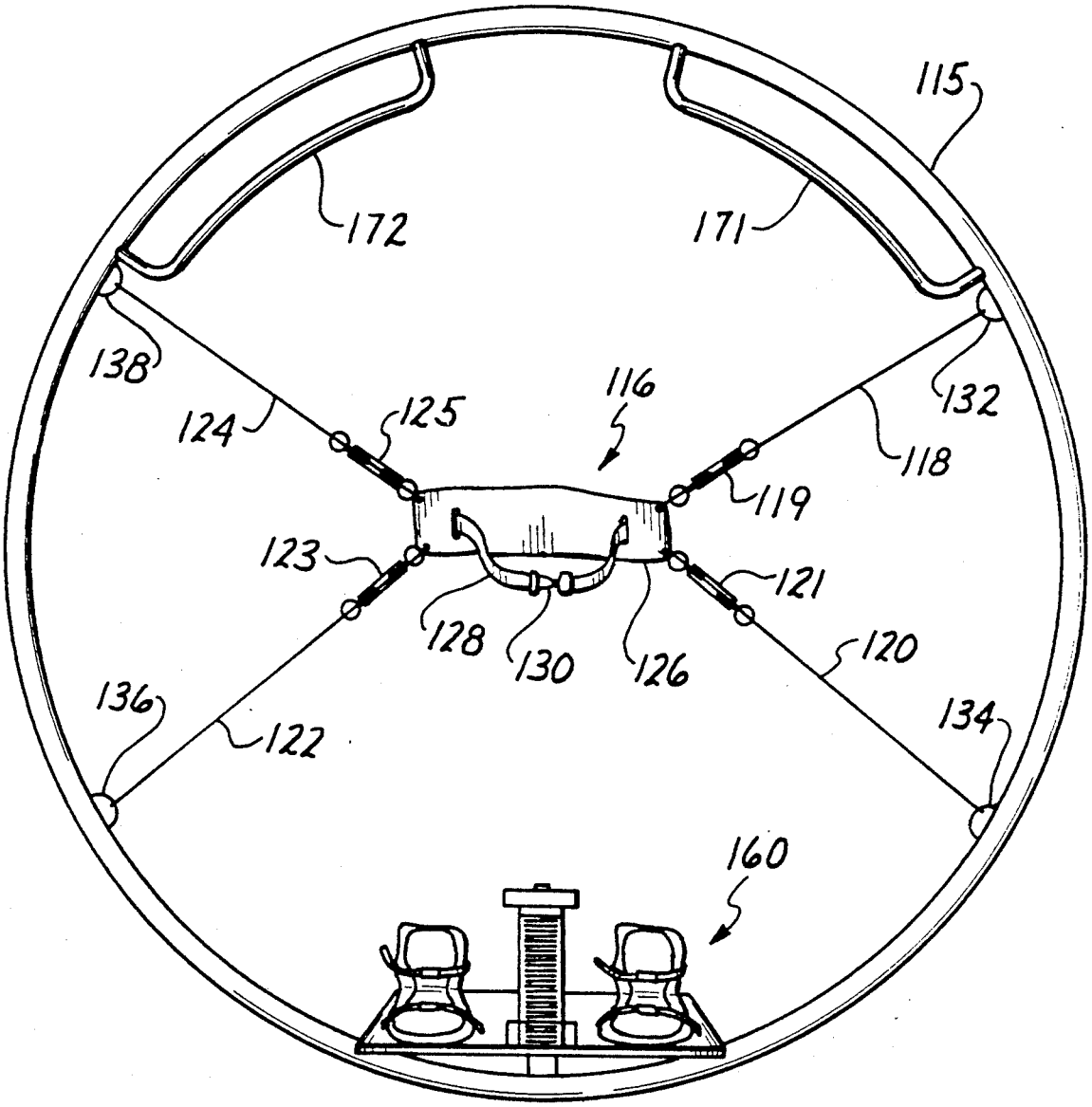
FIG. 6 is a front elevational view of a further embodiment of the structure of the inner ring assembly.

Referring particularly to FIG. 6, there is illustrated a further embodiment wherein a preferred operator station 116 is illustrated attached to and operably mounted within inner ring 115. Foot assembly 160 is positioned to assist the operator in generally the same manner previously described with reference to foot assembly 60. Rails 171 and 172 are provided for overhead grasping by the operator in generally the same manner previously described with reference to rails 71 and 72.

Operator station 116 comprises flexible tension cables 118, 120, 122 and 124 which are mounted to a flexible back brace 126 through turnbuckles 119, 121, 123 and 125, respectively. A safety belt 128 is provided to hold the operator securely against flexible back brace 126. Safety belt 128 opens and closes to secure and release the operator through the function of releasable safety buckle 130. Flexible tension cables 118, 120, 122 and 124 are secured to inner ring 115 by means of anchor points 132, 134, 136 and 138, respectively.

In operation the turnbuckles are preferably adjusted so that there is no more than a maximum of about six inches of fore and aft movement by the operator. This limiting of the operator's movement to a total of approximately six to twelve inches protects the operator's back from excessive strain and potential injury. The fore and aft movement of the operator is firmly but gently brought to a halt by the station 116 as the permitted limits of travel are reached. There is no sudden impact against a solid object. When combined with the shock absorbing nature of the yoke 30 and pedestal 35, this provides a very safe and comfortable ride. In general, the flexible tension cables or wires are not drawn fully taut. The permitted movement is provided for by leaving these cables slightly slack. The cables generally do not stretch or elongate significantly under the loads imposed on them. Alternatively, the cable system may include within it the capacity to stretch a limited amount. In this embodiment the cables are drawn taut and the desired fore and aft movement is provided by the limited elasticity in the cable system. The desired elasticity may be provided by pneumatic or hydraulic dampers or shock absorbers or by elastomeric materials, as desired.

Figure 7:
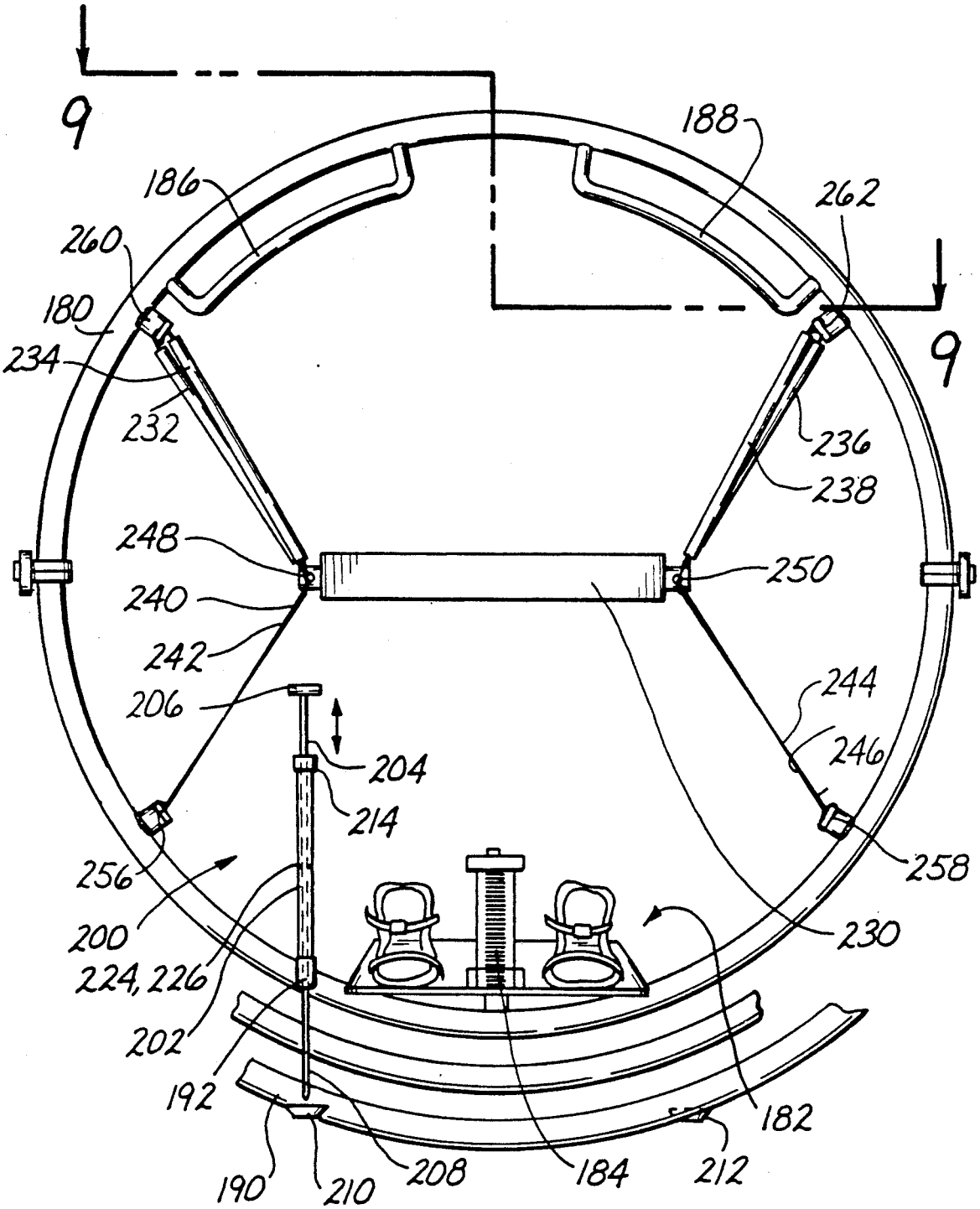
FIG. 7 is a front elevational view of still another embodiment of the structure of the inner ring assembly which includes an operator-actuated braking device.

Operator-actuated braking means 200 and preferred operator station 230 are illustrated in FIG. 7 attached to and operably mounted within inner ring 180. In this preferred embodiment, foot assembly 182 is positioned to assist the operator in generally the same manner previously described with reference to foot assemblies 60 and 160. Rails 186, 188 are provided for overhead grasping by the operator in generally the same manner previously described with reference to rails 71, 72, 171 and 172.

Operator-actuated braking means 200 allow an operator to maintain the inner ring 180 in a substantially stationary vertical position prior to safely mounting and dismounting the structure. Operator-actuated stop mechanism 200 includes, tube 202 which is fixed with respect to inner ring 180 at location 192. Tube 202 is positioned generally parallel to jack 184. Tube 202 is adapted to closely receive rod 204 therein. Handle 206, which is fixed to one end of rod 204, provides means for the operator to move the rod 204 rotatively and axially within tube 202. Receptacles 210 and 212 are adapted to receive therein the distal end 208 of rod 204. Receptacles 210, 212 are fixed to yoke 190 in a position whereby rod 204 may be aligned with either one of the receptacles 210, 212.

When operator is finished with his workout and desires to dismount from the apparatus, he first slows down until the outermost and intermediate rings are somewhat perpendicular with respect to the ground. Operator then waits for the distal end 208 of rod 204 to align with one of receptacles 210, 212. Upon alignment, operator inserts end 208 into receptacle and inner ring 180 is thereby held stationary in a vertical position. Operator is now free to safely detach himself from the foot assembly and operator station and dismount the structure. Safe single person operation is thus achieved.

Figure 8:
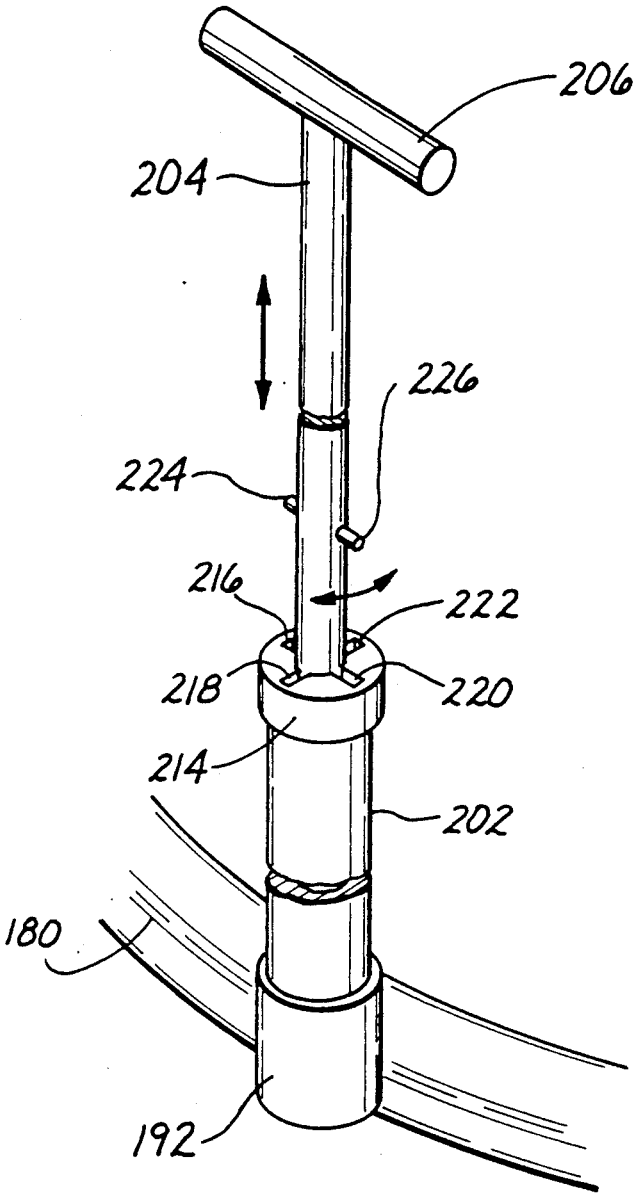
FIG. 8 is an enlarged perspective view of a portion of the operator-actuated braking device of FIG. 7.

Means are provided to alternatively hold the rod 204 into either a first position whereby the inner ring is locked in a vertical position, or into a second position whereby the structure is gyroscopically operative. The preferred method of locking the rod 204 in one of these positions is shown in more detail in FIG. 8. Cap 214 is fixed to the top of tube 202 and rod 204 is provided with two diametrically opposed radially extending projections 224 and 226. Cap 214 is provided with apertures 216, 218, 220 and 222. Apertures 216 and 220, and alternatively apertures 218 and 222, are adapted to receive projections 224 and 226 respectively therethrough, upon alignment, by rotation of handle 206. Rod 204 is spring loaded with respect to tube 202 to force axial movement of rod 204 to its first ring-locking position. To place rod 204 into its operative second position, projections 224, 226 are aligned with apertures 216, 220, or apertures 218, 222, by rotation of handle 206. Distal and 208 of rod 204 is then pulled from receptacle 210 or 212 by axial movement of rod 204 within tube 202 until projections 224, 226 pass the plane of apertures 216, 218, 220, 222. Handle 206 is then rotated to a position whereby projections 224, 226 are not aligned with any of apertures 216, 218, 220 222 and handle 206 is then released. The provision of multiple engagement positions facilitate usage. Rod 204 is thereby locked in place by engagement of projections 224, 226 with cap 214.

Figure 9:
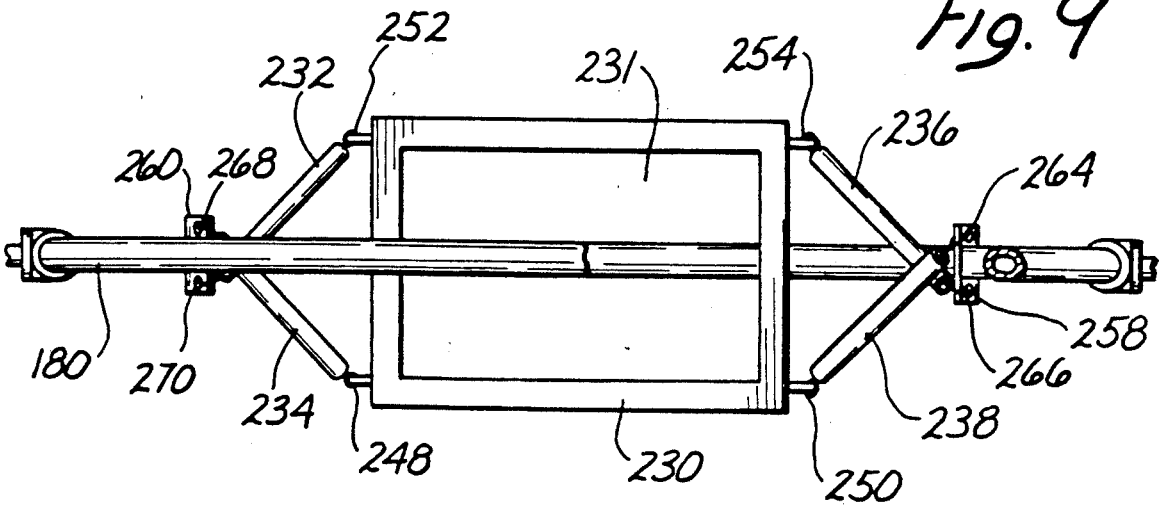
FIG. 9 is a sectional view of the structure on the line 9—9 of FIG. 7.

The preferred operator station illustrated, for example, in FIGS. 7 and 9 comprises flexible wire or cables 232, 234 236, 238, 240, 242, 244 and 246 which are mounted to hip retainer 230 at attachment points 248, 250, 252 and 254. Hip retainer 230 defines a hole or central opening 231 within which an operator may be retained. Flexible cables 232, 234, 236, 238, 240, 242, 244 and 246 are secured to inner ring 180 by attachment to brackets 256, 258, 260 and and 262. Each bracket includes two anchor points for attachment to cables or wires. For example bracket 260 is provided with anchor points 268 and 270; and bracket 258 with is provided with anchor points 264 and 266.

In operation, operator positions himself within hole 231 in hip retainer 230 upon mounting the structure. The rectangular shape facilitates entering retainer 230. Hip retainer 230 limits the fore and aft movement of the operator. Because the system is mounted on flexible cables or wires, the retainer moves slightly during use. This reduces the risk of injury and improves the ease, safety and comfort of use. A safety belt, not show, may be utilized inside of the retainer, if desired. This somewhat flexible system permits movement of the retainer of from a fraction of an inch to about 2 or 3 inches. This provides more control than a rigid system. It also generally forces the user to use the overhead bars for grasping.

While particular embodiments of the present invention have been called to attention, it will be obvious to those skilled in the art that changes and modifications may be made without departing from the invention in its broader aspects and, therefore, the aims of its appended claims are to cover all such changes and modifications as fall within the true spirit and scope of this invention.

Having described the invention, what is claimed as new in support of Letters Patent is:

1. A gyroscopic structure for manipulation by an operator in the guise of a human occupant, said gyroscopic structure comprising a supporting base, a ring assembly comprising a plurality of concentrically disposed rings of different diameters on said base for reception of the operator, an operator station positioned generally centrally of and attached to an innermost of said rings, a yoke on the base having a pivotally supporting engagement with laterally opposite sides of an outermost of said rings, said yoke being mounted on a single centrally positioned pedestal, there being a plurality of bearing assemblies interconnecting the innermost ring with the outermost ring at diametrically opposite locations, and operator mounting means cooperating with the operator station for releasably securing the operator in operating position on the operator station, said operator station being mounted to said innermost ring through flexible elements.

2. A gyroscopic structure as in claim 1 wherein said operator station includes an adjustment device between the operator station and the operator mounting means adapted to adjustably locate the position of the operator relative to the center of the ring assembly.

3. A gyroscopic structure as in claim 2 wherein said adjustment device includes a vertically adjustable crank device mounted on said innermost ring for adjusting the location of the operator relative to the ring assembly and a foot plate for support of the operator mounted on said crank device.

4. A gyroscopic structure as in claim 1 wherein said operator station includes a waistband intermediate diametrically opposite locations on said innermost ring for containment of the operator during operation of said gyroscopic structure.

5. A gyroscopic structure as in claim 4 wherein said waistband comprises a perimetrically extending multisection band having junctions between adjacent ends of said sections, one of said junctions being a movable junction and another of said junctions being a releasable interlocking junction.

6. A gyroscopic structure as in claim 1 wherein said ring assembly comprises at least three concentric rings, there being a first pair of bearings connecting the innermost of said rings to an intermediate one of said rings on one axis of rotation and a second pair of bearings connecting the intermediate one of said rings with the outermost of said rings on another axis of rotation.

7. A gyroscopic structure as in claim 6 wherein said bearings comprise each an assembly of radially inner and outer parts located in a space between adjacent rings, one of said parts having a centrally disposed shaft anchored to the corresponding adjacent ring at one side and the other of said parts having a centrally disposed shaft anchored to the corresponding adjacent ring at an opposite side.

8. A gyroscopic structure as in claim 1 wherein said operator station includes a hip retention device intermediate diametrically opposite locations on said innermost ring; said hip retention device having a hole therein; said hole adapted to receive therein the hips of an operator and thereby retain said operator from substantial fore and aft movement during operation of said gyroscopic structure.

9. A gyroscopic structure as in claim 1 wherein said flexible elements are substantially inelastic.

10. A gyroscopic structure for manipulation by an operator in the guise of a human occupant, said gyroscopic structure comprising a supporting base, a ring means assembly on said base for reception of the operator, an operator station mounted within said ring means, a yoke on the base having a pivotally supporting engagement with laterally opposite sides of said ring means, there being a plurality of bearing assemblies interconnecting the ring means with the yoke at diametrically opposite locations and operator mounting means at the operator station adapted to releasably secure the operator in operating position at the operator station, said yoke being mounted to said base through a single pedestal.

11. A gyroscopic structure for manipulation by an operator in the guise of a human occupant, said gyroscopic structure comprising a supporting base, a ring assembly comprising a plurality of concentrically disposed rings of different diameters on said base for reception of the operator, an operator station positioned generally centrally of and atached to an innermost of said rings, a yoke on the base having a pivotally supporting engagement with laterally opposite sides of an outermost of said rings, said yoke being mounted on a single centrally positioned pedestal, there being a plurality of bearing assemblies interconnecting the innermost ring with the outermost ring at diametrically opposite locations, and operator mounting means cooperating with the operator station for releasably securing the operator in operating position on the operator station, said gyroscopic structure including a releasable ring locking device having one position adapted to interlock the rings of said ring assembly and said yoke in a stationary position and having a second position adapted to release the rings of said ring assembly from said yoke.

12. The gyroscopic structure as in claim 11 wherein said ring locking device comprises an axially slidable rod fixed to said innermost ring, at least one receptacle fixed to said yoke, said receptacle having an opening therein adapted to closely receive one end of said rod, said rod further having a handle thereon positioned within reach of said operator when mounted on the operator station whereby said operator can slide said rod into said receptacle upon alignment of said rod end and said opening.

13. A gyroscopic structure for manipulation by an operator in the guise of a human occupant, said gyroscopic structure comprising a supporting base, a ring assembly comprising a plurality of concentrically disposed rings of different diameters on said base for reception of the operator, an operator station positioned generally centrally of and attached to an innermost of said rings, a yoke on the base having a pivotally supporting engagement with laterally opposite sides of an outermost of said rings, said yoke being mounted on a single centrally positioned pedestal, there being a plurality of bearing assemblies interconnecting the innermost ring with the outermost ring at diametrically opposite locations and operator mounting means cooperating with the operator station for releasably securing the operator in operating position on the operator station.

* * * * *